US009132360B2

(12) United States Patent
Rosenzweig et al.

(10) Patent No.: US 9,132,360 B2
(45) Date of Patent: Sep. 15, 2015

(54) LIGHT-UP TOY

(76) Inventors: Joel Rosenzweig, Mineola, NY (US); Martin Barry Abrams, Kings Point, NY (US)

( * ) Notice: Subject to any disclaimer, the term of this patent is extended or adjusted under 35 U.S.C. 154(b) by 199 days.

(21) Appl. No.: 13/293,220

(22) Filed: Nov. 10, 2011

(65) Prior Publication Data

US 2012/0135666 A1 May 31, 2012

Related U.S. Application Data

(60) Provisional application No. 61/418,147, filed on Nov. 30, 2010.

(51) Int. Cl.
*A63H 33/22* (2006.01)
*A63H 1/32* (2006.01)

(52) U.S. Cl.
CPC . *A63H 33/22* (2013.01); *A63H 1/32* (2013.01)

(58) Field of Classification Search
USPC ..... 446/242, 247–254, 397, 484, 485
See application file for complete search history.

(56) References Cited

U.S. PATENT DOCUMENTS 2,623,327 A * 12/1952 Testino ..... 446/242
2,739,419 A * 3/1956 Cleveland ..... 446/242
2,836,009 A * 5/1958 Wang ..... 446/242
2,841,922 A * 7/1958 Kolintzas ..... 446/242
3,971,158 A * 7/1976 Hanson ..... 446/242
4,552,542 A * 11/1985 Reysman ..... 446/254
4,563,160 A 1/1986 Lee
5,236,383 A * 8/1993 Connelly ..... 446/219
5,399,136 A * 3/1995 Bart ..... 482/110
6,083,076 A * 7/2000 Saint-Victor ..... 446/242
6,200,189 B1 * 3/2001 Coleman et al. ..... 446/298
6,467,939 B2 * 10/2002 Deutsch et al. ..... 362/500
6,482,137 B2 * 11/2002 Walker ..... 482/110
6,572,251 B1 * 6/2003 Huang ..... 362/500
6,595,823 B2 * 7/2003 Huset ..... 446/46
6,776,680 B2 * 8/2004 Chow ..... 446/247
6,802,758 B2 10/2004 Somers
7,229,182 B2 * 6/2007 Schrader et al. ..... 362/108
7,361,074 B1 * 4/2008 Periman et al. ..... 446/242
7,766,718 B2 * 8/2010 Rago et al. ..... 446/242
2002/0068505 A1 * 6/2002 Williams ..... 446/485
2006/0073759 A1 * 4/2006 Rooney ..... 446/192
2007/0281581 A1 * 12/2007 Rago et al. ..... 446/242

* cited by examiner

*Primary Examiner* — Nini Legesse
(74) *Attorney, Agent, or Firm* — Richard Mark Blank, Esq.

(57) ABSTRACT

The invention is a light up toy with two or more lights manipulated by one or more strings to create patterns of light and light shows. The lights have covers to protect the lights from breaking and can protect the user or a bystander from the impact of the lights as well. The toy can be made with battery sections so that a dead battery can be changed and the toy can continue to be used with fresh batteries.

17 Claims, 16 Drawing Sheets

LIGHT-UP TOY

This application claims the benefit under 35 U.S.C. 119(e) of U.S. Provisional Application No. 61/418,147, having a filing date of Nov. 30, 2010, the entire disclosures of which are incorporated herein by reference.

FIELD OF INVENTION

The present invention relates to a light-up toy that operates on a string(s) held by a user, where the lights make patterns in the air (light shows).

BACKGROUND OF THE INVENTION

There are known light up toys that make light shows, but none with the particular features of the present invention. For example, glow sticks or flashlights, by their nature, are not evenly balanced and thus are difficult to spin for any duration.

SUMMARY OF THE INVENTION

A light up toy of the invention includes a device having one or more of these features: one or more lights; at least one string threaded through the device; one or more handles at least one end of the string(s); at least one battery section in the device; a transparent cover for each of the one or more lights to protect the lights from breaking; and a means for locking the cover in place.

Another object is to provide protection from damage to other objects or individuals while being operated. Accordingly the toy can have a protective resilient covering on the hub and the various light emitting elements. Further the string like support can have resilient pads to protect the operator's hands and fingers while operating.

BRIEF DESCRIPTION OF THE DRAWINGS

The present invention will be more readily understandable from a consideration of the accompanying drawings in which.

DETAILED DESCRIPTION OF THE INVENTION

Figure 1:
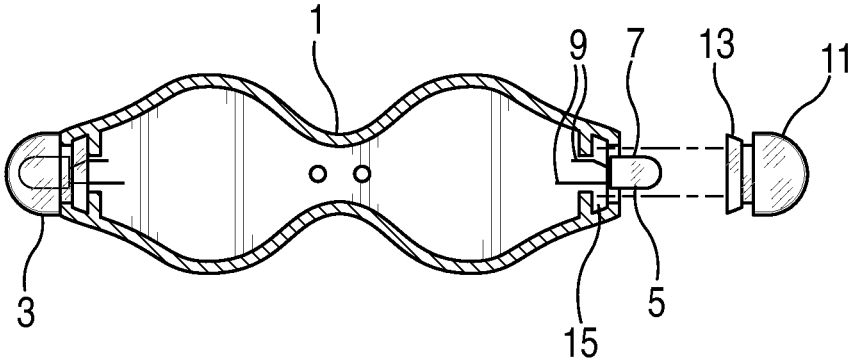
FIG. 1 depicts a top and view of an exemplary two light units and FIG. 1A depicts a cross section of the light bulb and cover.

A light-up toy that operates on a string(s) held by a user, where the lights make patterns in the air (light shows) and the toy includes one or more of the following features:

1) A light-up toy with 2 or more lights in each unit, each of the light units being capable of being carried on a string (s) and being capable of being connected to other light units by a clip or other device for connecting the units. Each of the light units can be manufactured as a precision balanced instrument specially made to spin on its axis when the string(s) is moved. Each of the lights in the units project the same or different colors, or are capable of changing color using a manual or automatic switch; and/or
2) A light-up toy where the 2 or more light units are molded together as a one piece molded product design; and/or
3) Handle(s) at the ends of the string(s) to aid in holding and securing the string(s). The holders can be specially adapted to fit one or more fingers or an entire hand, wrist, arm, leg or other body part or stationary item to hold the string(s). The handles can be made of plastic or other suitable materials. The handles can connect to each other and fold into the toy for storage, or the handles can collapse into the toy for storage. The handles can include lights too. The handles can interact with or communicate with the unit(s) to activate/deactivate lights and/or sound/music; and/or
4) The lights in the unit(s) and/or the handles can be capable of being activated by sound, including music; and/or
5) One or more battery sections with one or more screws that is easily accessible to open the battery section and change the battery or batteries; and/or
6) Covers for the lights to protect the lights from breaking. The covers can also protect the toy from breakage. The covers can also protect the user or onlooker from impact if the toy hits them, it lessens the blow. The covers can be made of various transparent materials to allow the light to come through and the covers can even expand the amount of light or channel the light in different directions or diffuse the light so that it is not so bright, but more spread out, or create a shape for the light to illuminate or diffuse the light such that the light is better seen from the side instead of from the front. Plastic is one type of transparent material for the light cover. For example, a soft, rubbery plastic or a resilient plastic can be used to provide protection from impact. Similarly, foam or another suitable material can also be used as the covers. The covers can also be made to lock in place in the light unit; and/or
7) A music player and/or speakers can be attached to or located in the handles and/or in the one or more units having the lights. The music player can be a recorded chip, a memory chip, an MP3 type or other type of player. The music can be turned on/off by a switch or automatically turned on when the light unit is in motion and automatically turned off when the motion of the light unit stops. For example, the switch can be activated by centrifugal motion; and/or
8) The unit(s) or one and/or both of the handles can include a microphone for emitting sound selected or made by the user; and/or 9) Additional lights can be added, preferably of any shape that is symmetrical and balanced, e.g., two light up and/or balancing balls can be attached to the unit on either side, each being the same weight and size, or two glow light sticks, each being the same weight and size. The lights on the toy or the additional lights can be, for example, LED lights, strobe lights, fiber optics, black lights, fluorescent lights, circuit board lights, or white color units reactive to Ultra Violet lights. For example, the lights can have a material on it or coated with a material in whole or in part that reacts with black light or Ultra Violet light; and/or 10) A kit including the toy and an instruction book on how to do tricks and create patterns with the lights.

The light up toy of the present invention is a precision balanced instrument specially made to spin on it's axis by swinging the string around and applying tension and slack to create a "continuous movement".

The lights turn the movement into amazing "Light Shows". By spinning the light up toy around, the user can create wonderful large "Orbit Rings". Turning the light up toy sideways creates Slick Sidewinders, pulling tight creates whizzing Black Holes and loosening up makes Shooting Stars or Loop de Loops. Different types of spinning create new and unique tricks with all different types of effects. Examples of tricks that can be performed include, but are not limited to: Large Orbits, Small Orbits, Shooting Stars, Mini Stars, Loop de Loops, Black Holes and figure 8's.

A variety of patterns can be made using the lights. Examples include, but are not limited to, orbits (circles), stars, flowers, shooting stars, mini stars, loop de loops, black holes and figure 8's.

Figure 1A:
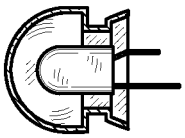
Figure 2A:
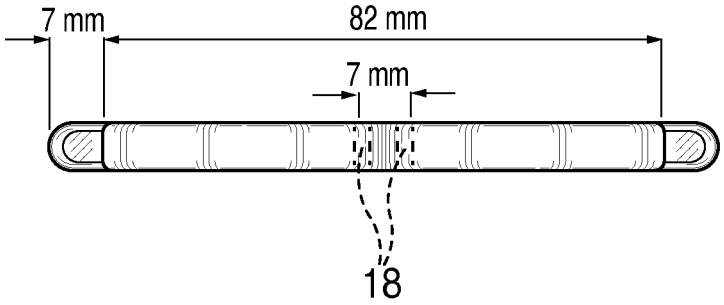
FIG. 2 shows an exemplary two light unit in a front side view 2A, a right side view 2B, a top view 2C and a bottom view 2D.
Figure 2B:
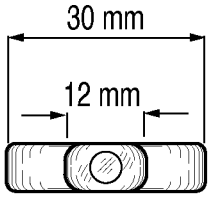
Figure 2C:
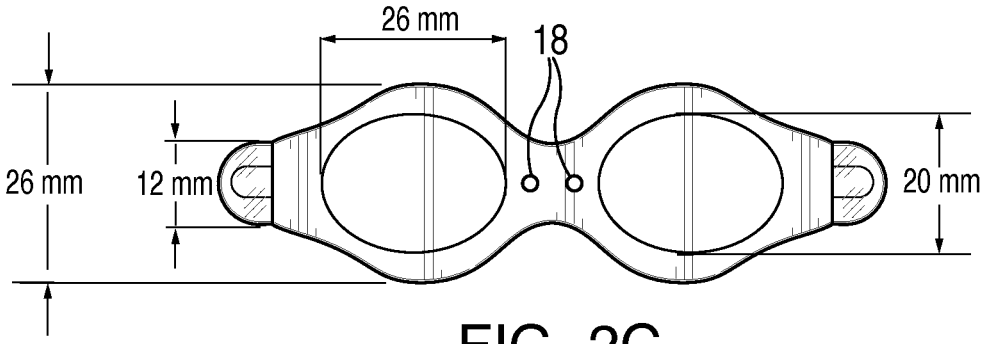
Figure 2D:
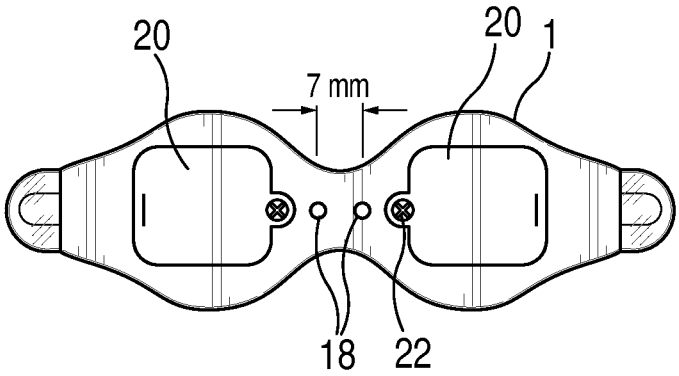

FIG. 1 shows a top view of an exemplary two light unit 1. The top view of the two light unit 1 shows a light and light cover at end 3 of the light unit 1. FIG. 1A is a cross-sectional view of end 3. End 5 of unit 1 shows an exploded view of a light 7 with connecting wires 9, and a light cover 11 with a flange 13 to lock or anchor the cover 11 in place in groove 15 of the unit 1.

FIG. 2 depicts an exemplary two light unit 1 in a front side view 2A, a right side view 2B, a top view 2C and a bottom view 2D. Each view includes exemplary measurements of the length and width of light unit 1. The shape and dimensions of light unit 1 are balanced so that the unit 1 will spin on its axis using a string inserted through holes 18. Thus, the exemplary measurements of the length and width of light unit 1 can be varied to keep the dimensions are balanced so that the unit 1 will spin on its axis using a string inserted through holes 18. The top view 2C shows two holes 18 in the middle of the unit for threading a string or strings (although one or more holes can be used for this purpose). The bottom view 2D shows covers 20 for battery compartments locked in place with screws 22. The screws 22 are shown at the adjoining ends of the covers 20, as an example for locating the screws, for easy opening and closing of the battery covers 20. The battery section holds one or more batteries. The dimensions shown in the figures can be smaller or larger than the exemplary measurements.

Figure 3A:
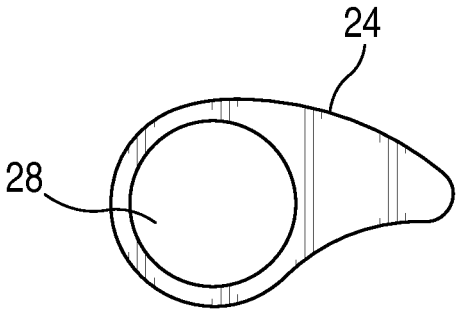
FIG. 3 shows top views of handles in FIGS. 3A and 3C, a side view 3B of the handle along its longer axis, and a side view 3D of the handle along its shorter axis.
Figure 3B:
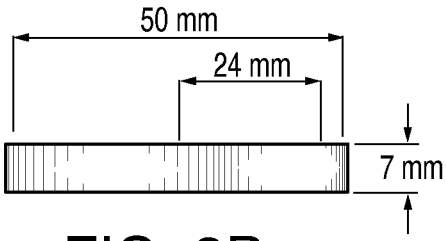
Figure 3C:
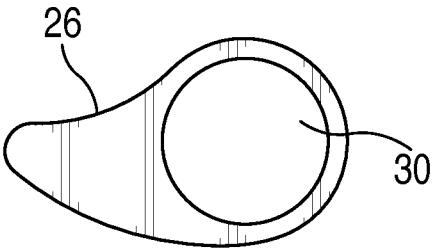
Figure 3D:
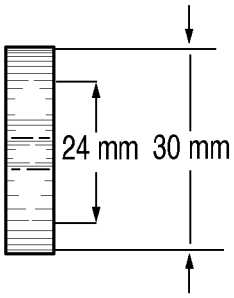

FIG. 3 shows examples of handles 24 and 26 in FIGS. 3A and 3C, respectively, with exemplary measurements for length and width. Handles 24 and 26 have holes 28 and 30, respectively. The holes 28 and 30 can be small enough to fit on a user's finger or large enough to encircle a user's wrist. Also, either hole 28 or hole 30 can be sized to fit on a stationary pole or other object, while the other of hole 28 or hole 30 can be held by a user. FIG. 3B shows a front side view of the handles and FIG. 3D shows a right side view of the handle. Again, the dimensions can be smaller or larger than the exemplary measurements. The handle holds one end of the string(s) threaded through the light unit. Two handles can be used, one for holding each end of the string(s). The opening in the handle can be sized for a finger, as shown in the drawing, or two or more fingers, or a larger body part, such as a wrist, or a stationary post for holding one end of the string(s). The dimensions shown in the figures can be smaller or larger than the exemplary measurements.

Figure 4:
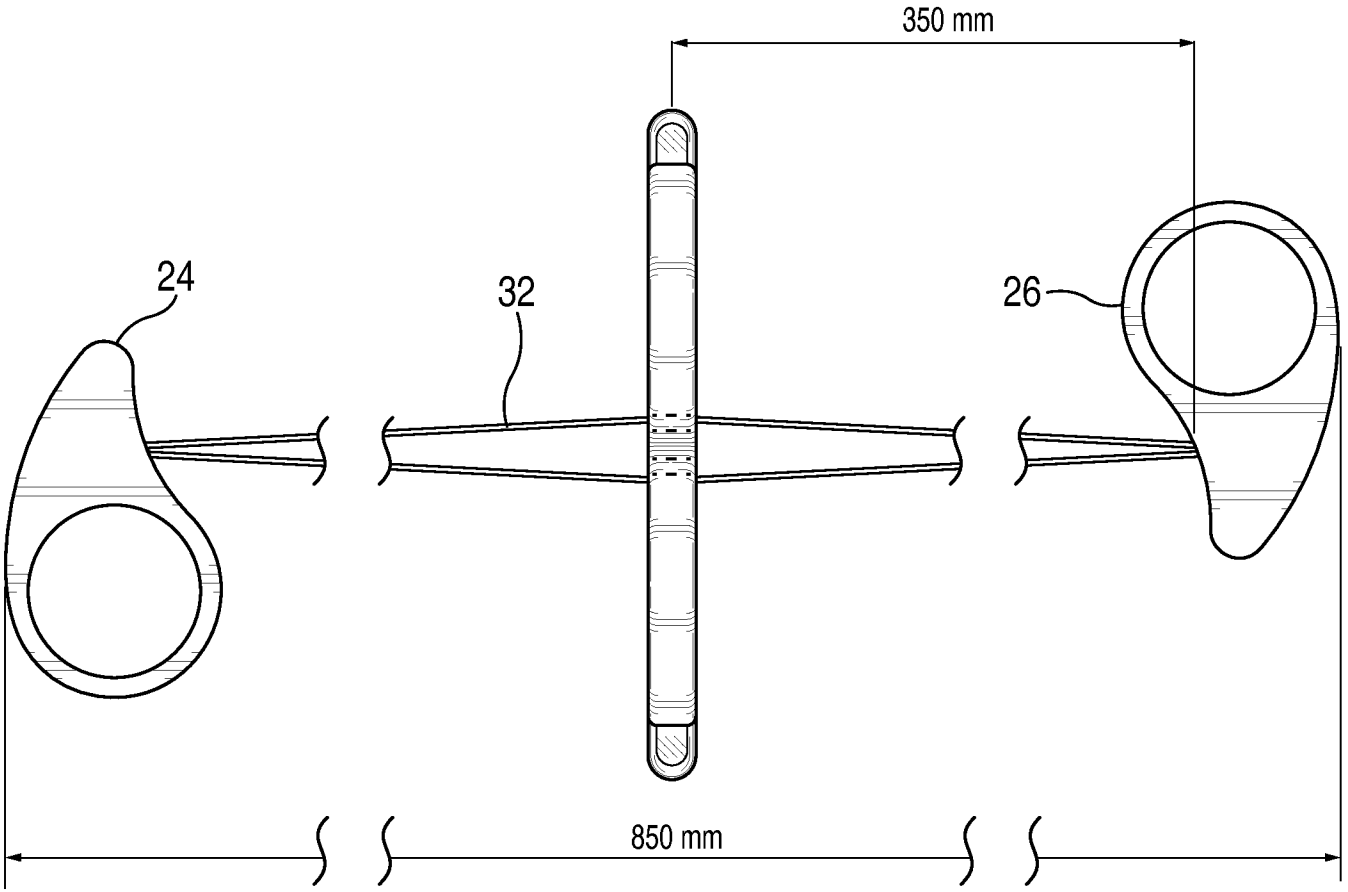
FIG. 4 depicts a side view of an exemplary two light unit with handles and a string.

FIG. 4 depicts a side view of unit 1 with handles 24 and 26 attached to each other and to unit 1 with a string 32. Also, FIG. 4 includes an example of the total length of the string 32 and an example of the length of the string from unit 1 to handle 26. FIG. 4 shows a front side view of a two light unit 1 in a vertical position, as opposed to the horizontal position shown in FIGS. 1 and 2. Also shown are exemplary measurements of the string(s). The dimensions shown in the figures can be smaller or larger than the exemplary measurements.

Figure 5:
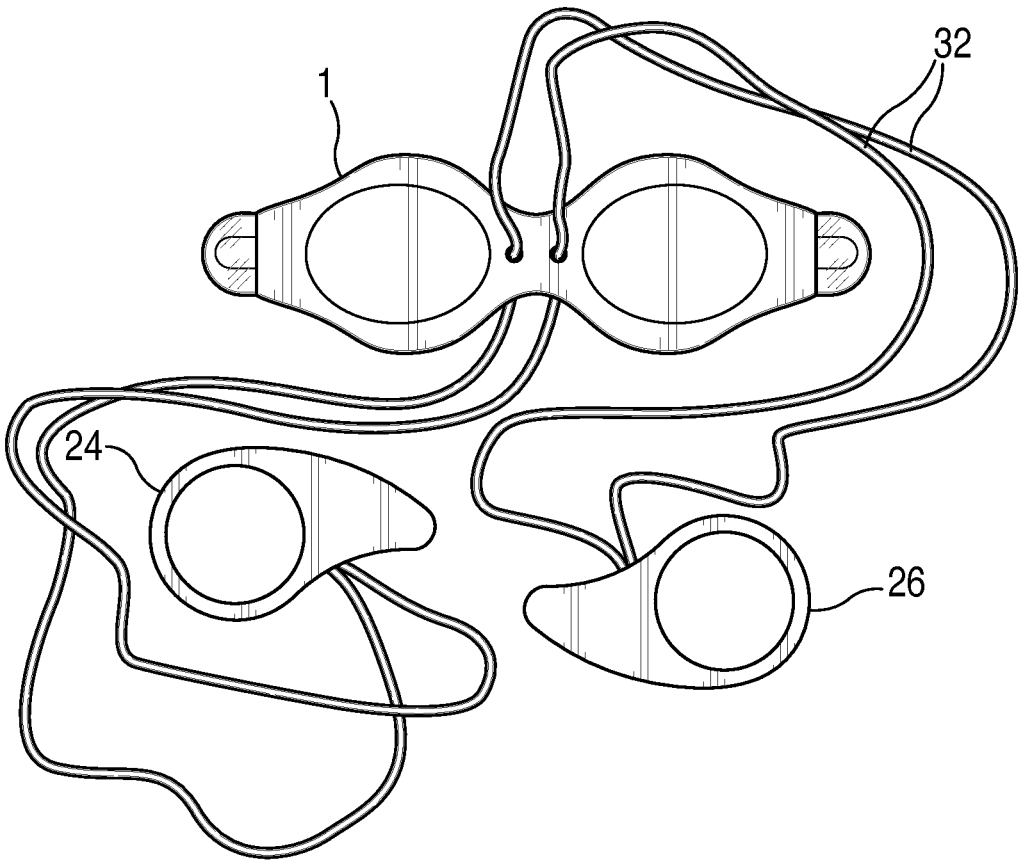
FIG. 5 shows an example of a two light unit.
Figure 6:
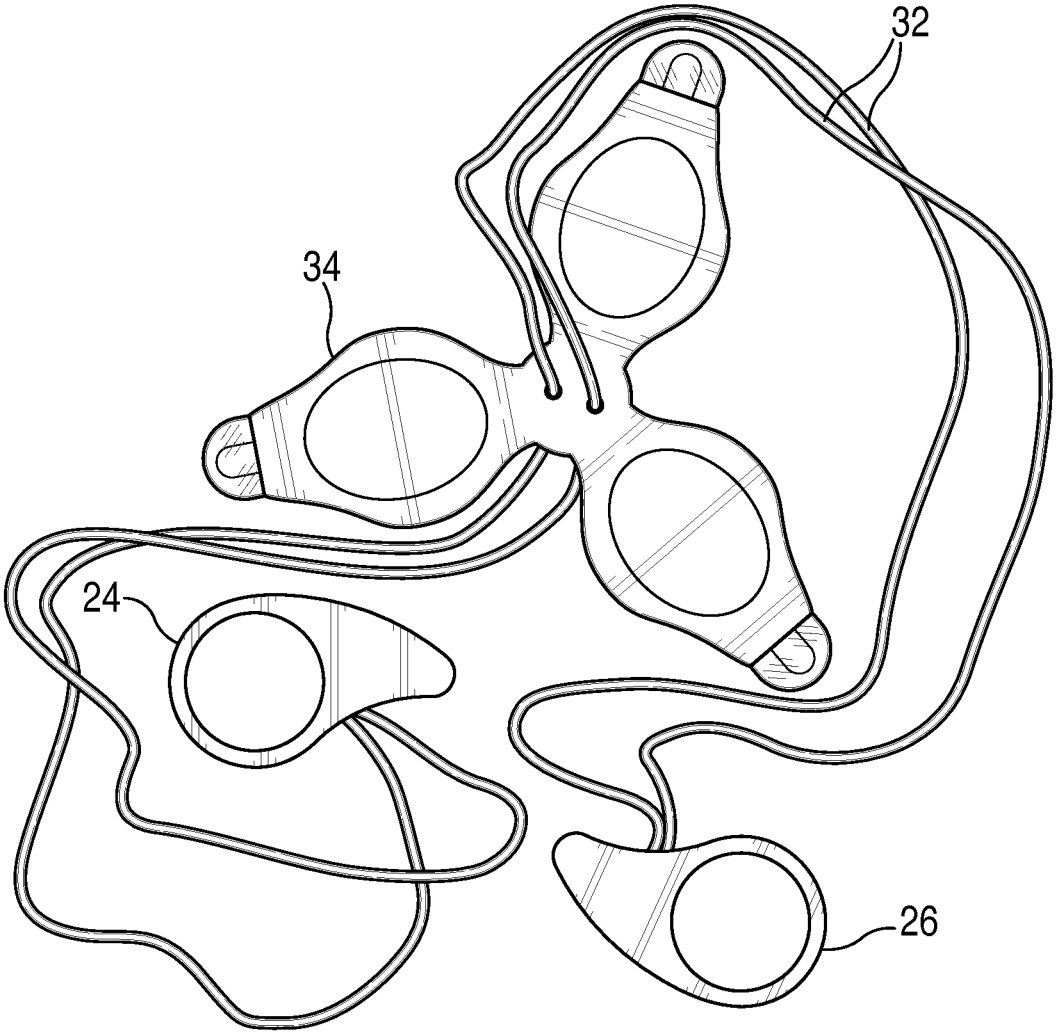
FIG. 6 depicts an example of a three light unit.
Figure 7:
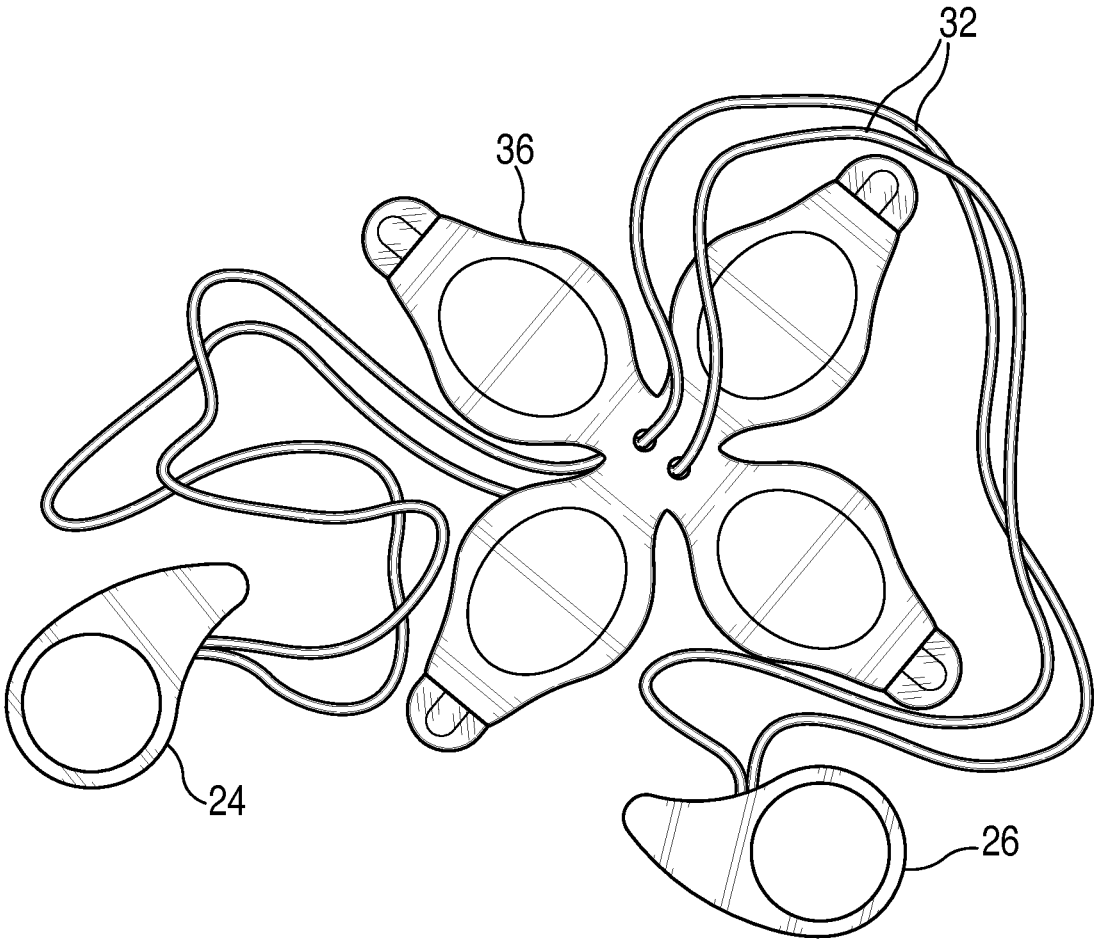
FIG. 7 shows an example of a four light unit.

FIGS. 5, 6 and 7 depict examples of a two light unit 1, a three light unit 34, and a four light unit 36, respectively. The lights in each unit can be of the same or different colors.

Figure 8A:
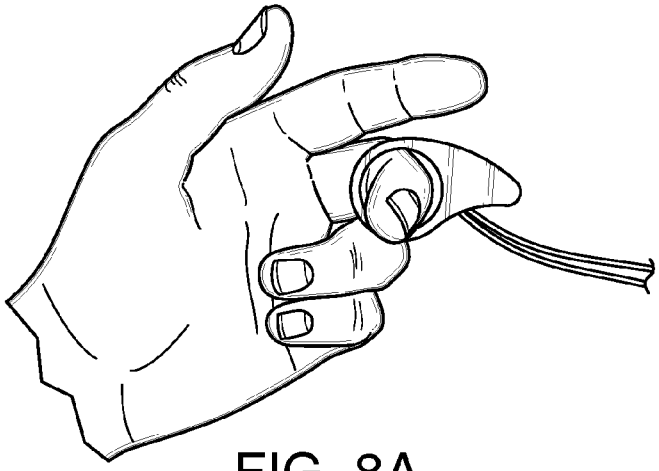
FIGS. 8A, 8B and 8C illustrate steps for one way to hold a handle.
Figure 8B:
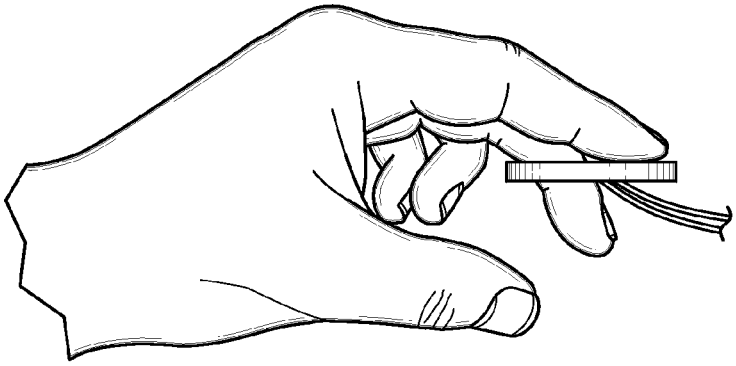
Figure 8C:
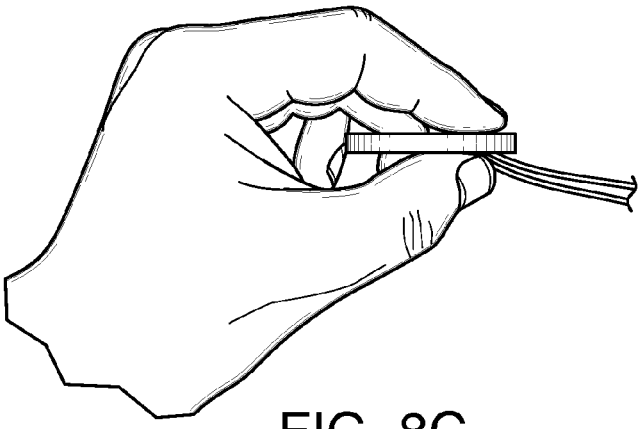
Figure 9A:
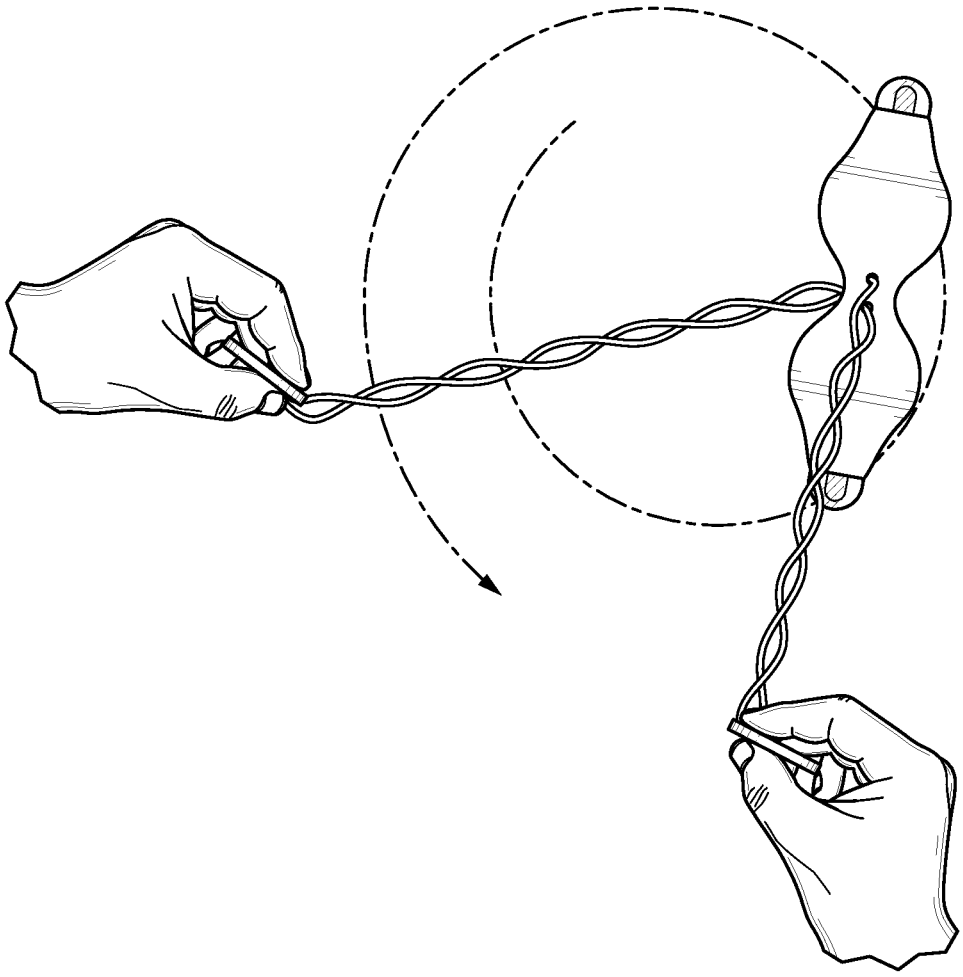
FIGS. 9A, 9B, 9C and 9D illustrate a series of steps for examples of ways to use the light up toy.
Figure 9B:
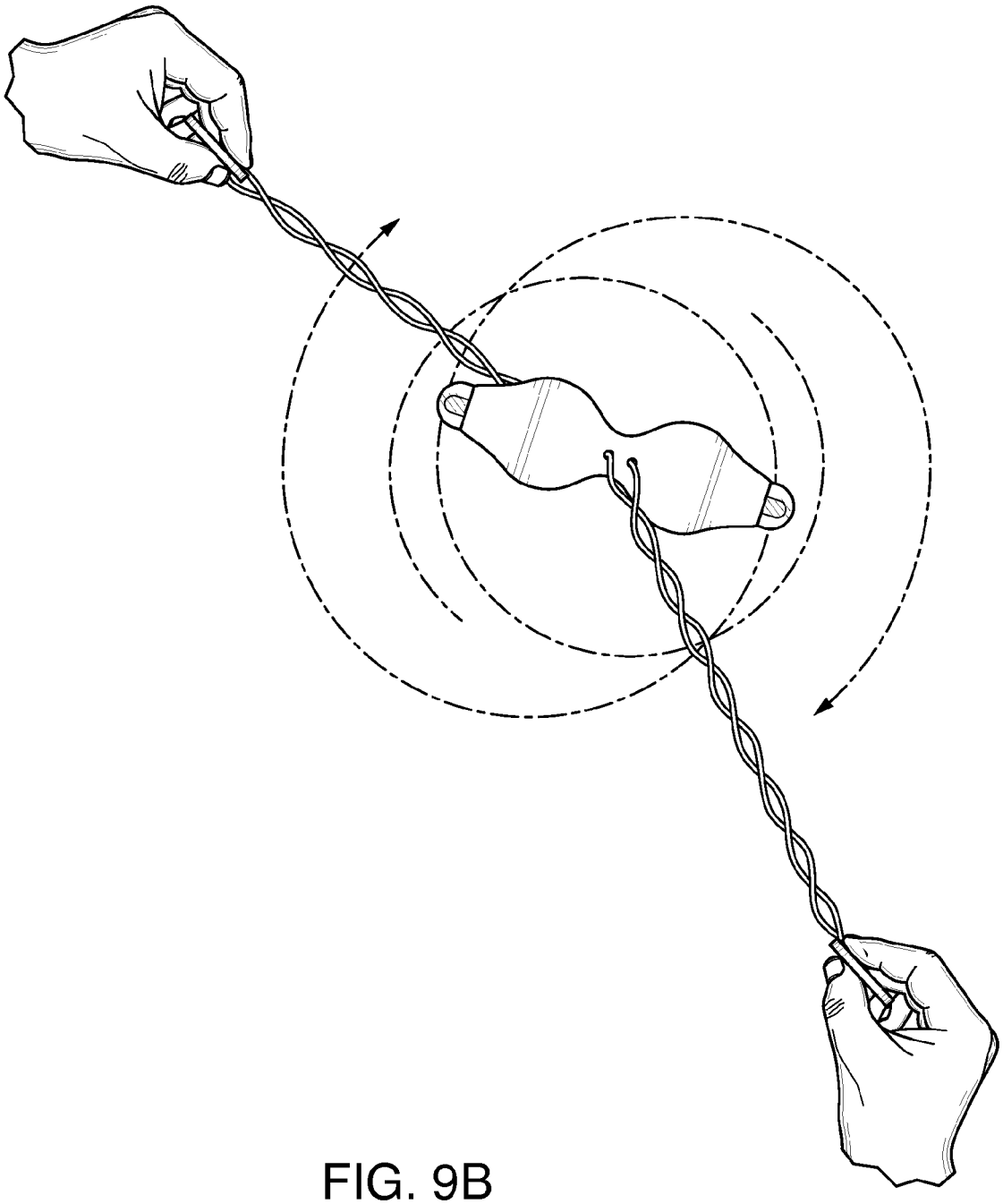
Figure 9C:
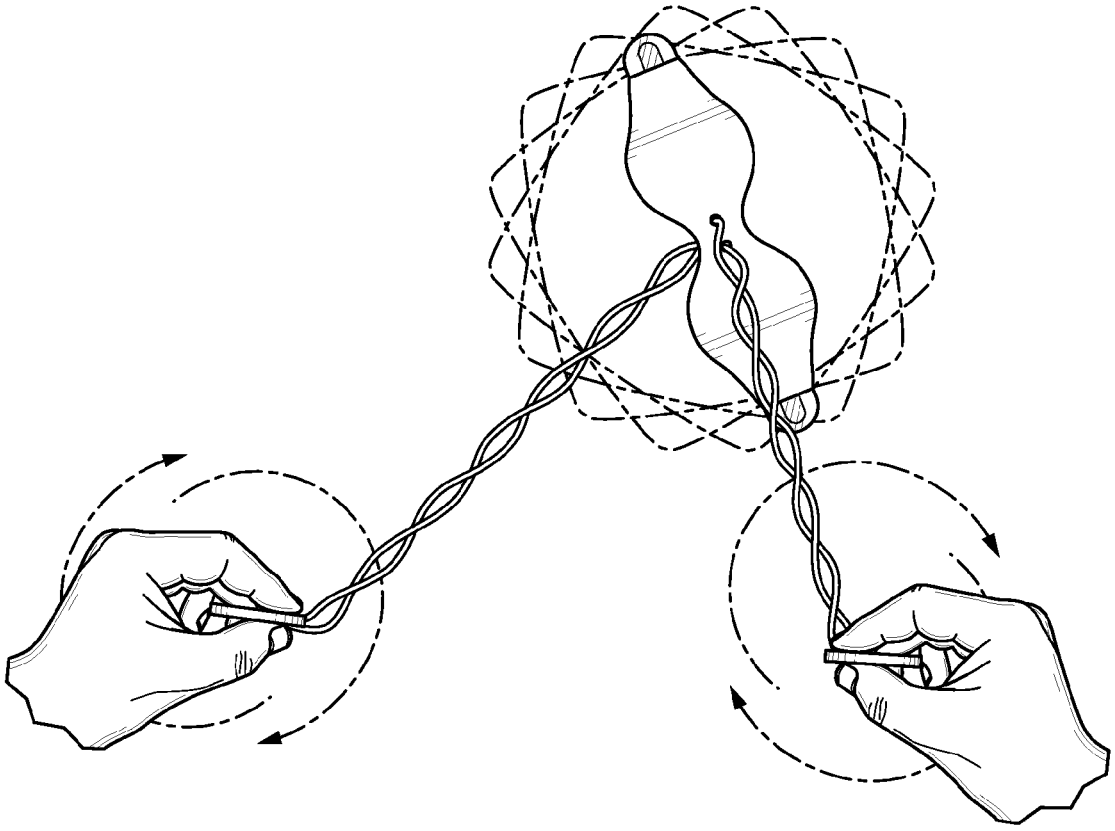
Figure 9D:
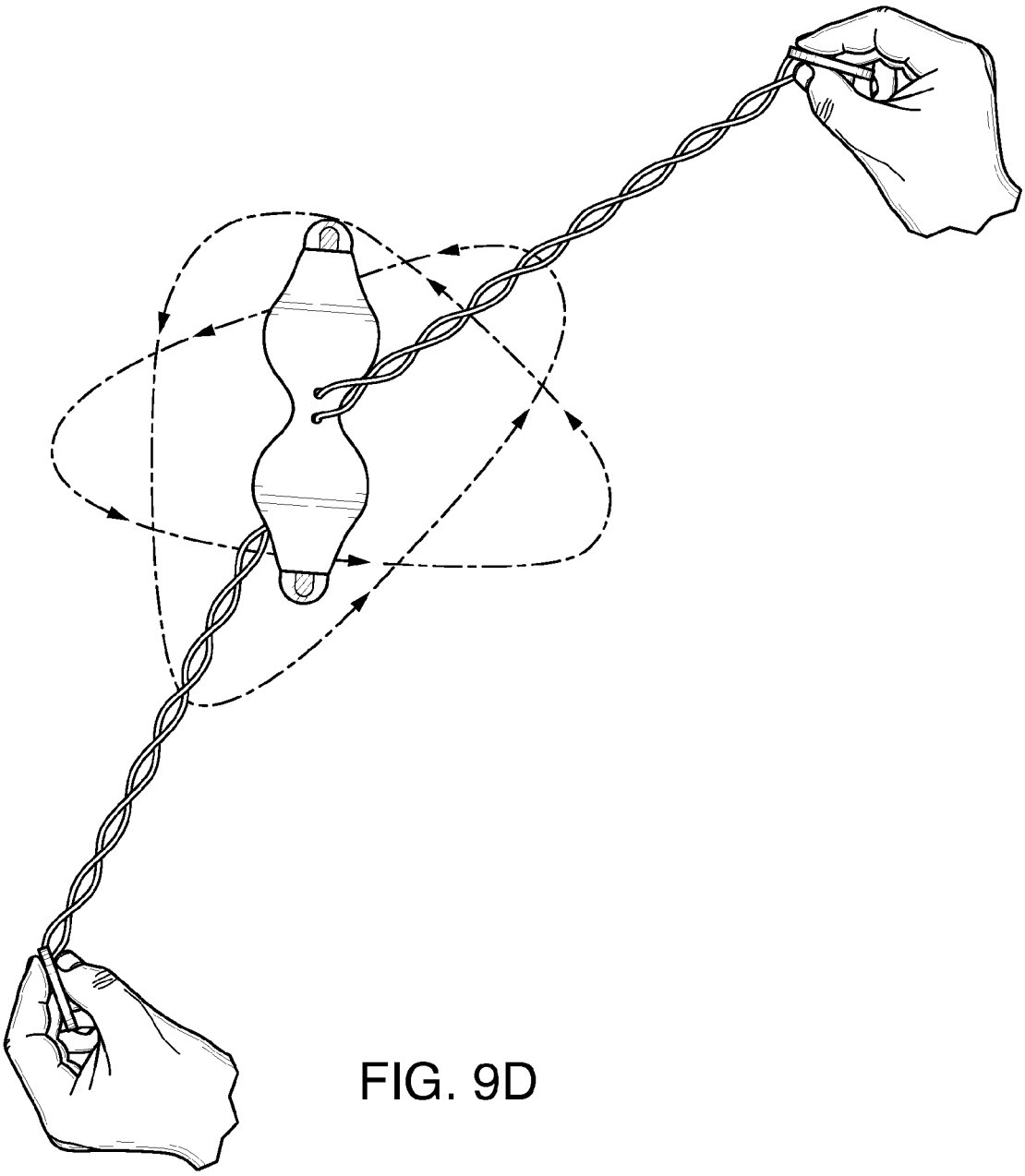

FIG. 8 illustrates a series of steps for one way to hold the handle 24 and/or 26. In 8A, the user inserts his or her middle finger through the hole of the handle. FIG. 8B shows the user's pointer finger positioned on the top of the handle. FIG. 8C shows the user's thumb positioned on the bottom part of the handle.

FIG. 9 illustrates a series of steps for one way to use the light up toy. FIG. 9A shows the user's hands moving in a circular motion to create large orbits. In FIG. 9B, the user pulls both ends of the string apart to move the light-up toy in the direction opposite to that in FIG. 9A to create smaller and faster orbits. In FIG. 9C, the string is pulled less tautly and, while the light-up toy is spinning on its axis, the user's hands are moved in a circular motion to create light shows. FIG. 9*d* shows the ends of the string being pulled tautly apart again after the string has become wound up. Then, more advanced light shows can be created by the user moving his or her hands in different directions and/or at different angles.

Other lights can be used, instead of or in addition to LED lights, such as glow light sticks, fiber optics, strobe lights, and white color units reactive to Ultra Violet lights.

Figure 10:
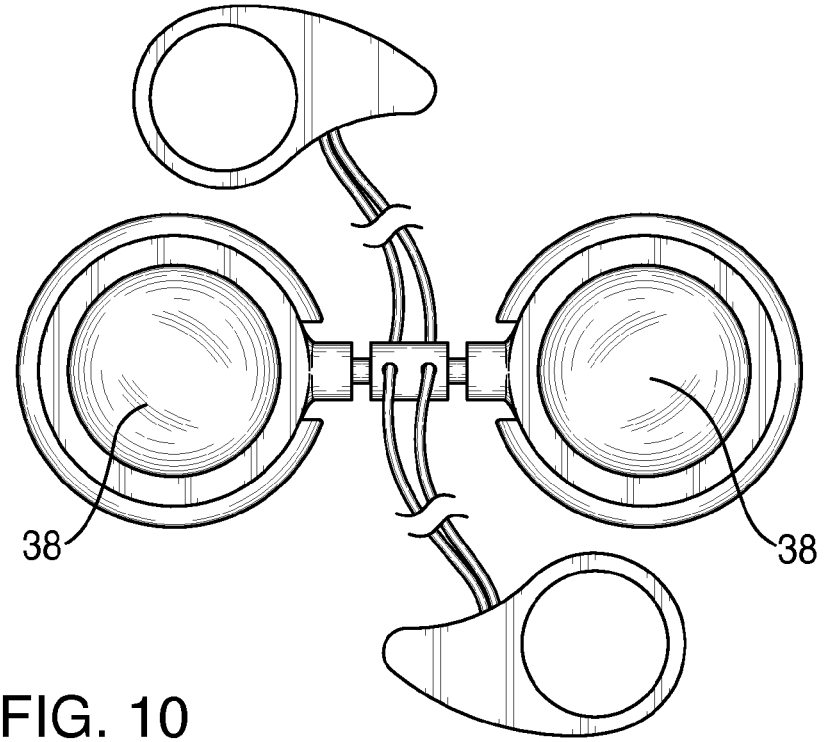
FIG. 10 shows an example of a two light unit.

FIG. 10 is an exemplary unit with ball shaped light covers 38.

Figure 11:
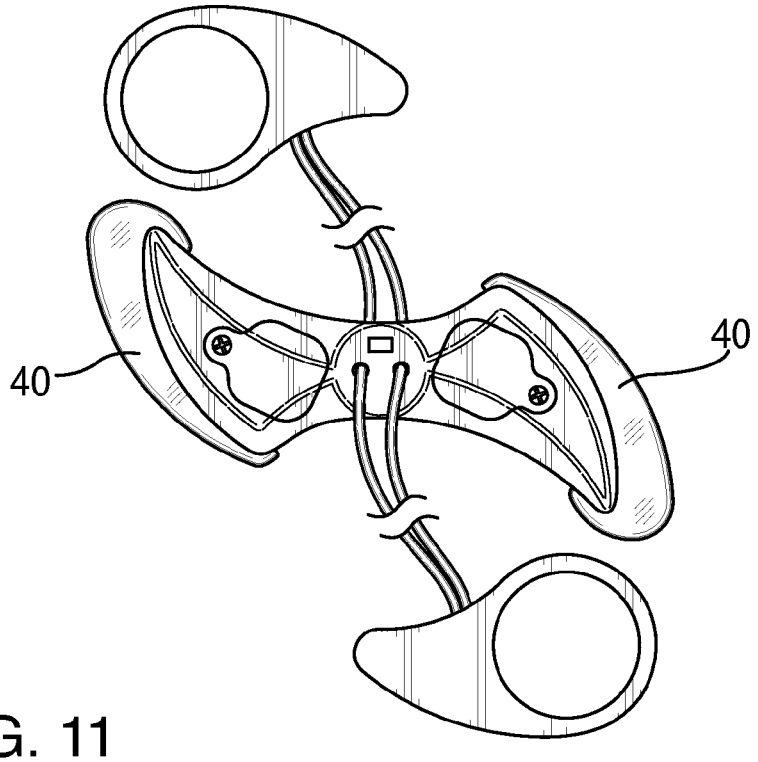
FIG. 11 depicts an example of a light up toy with six lights.

FIG. 11 is a light up toy with a light cover 40 that can cover one or more of the same or different colored lights, for example, two, three, four or more lights.

Figure 12:
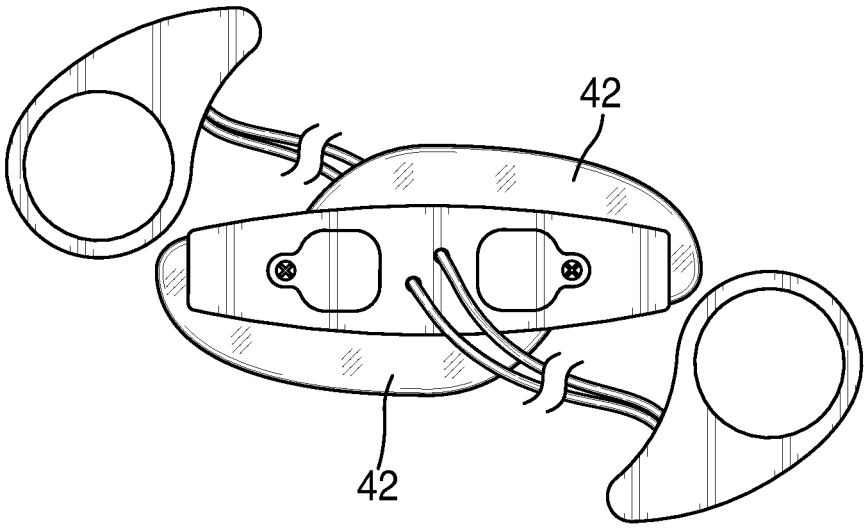
FIG. 12 shows an example of a light up toy with eight lights.

FIG. 12 is a light up toy with a light cover 42 that can cover one or more of the same or different colored lights, for example, two, three, four or more lights.

Figure 13:
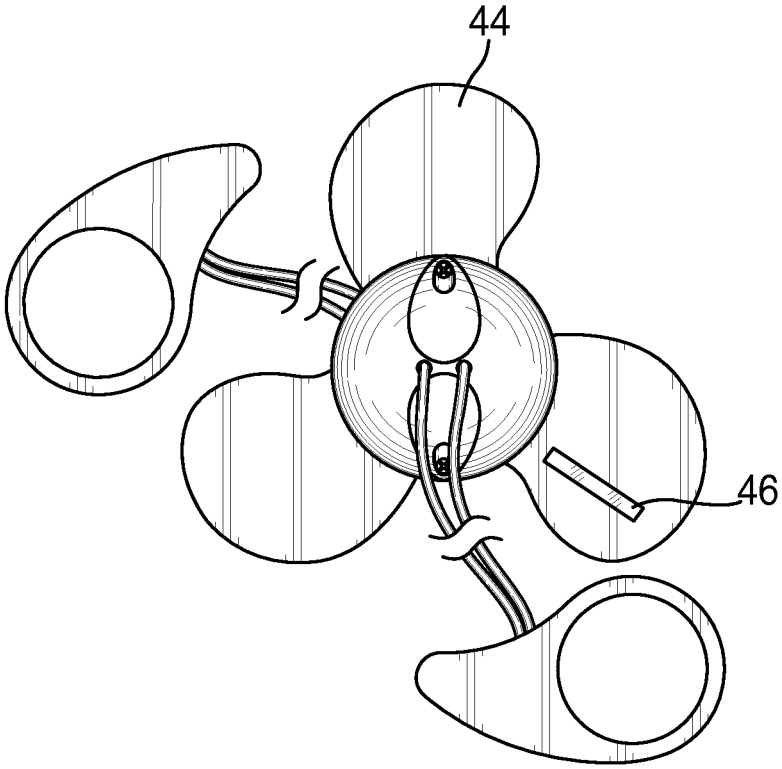
FIG. 13 depicts a propeller shaped light up toy.

FIG. 13 is a propeller shaped light up toy. The blades 44 can be made of any material, but a soft material, e.g., rubber, can be used to provide a soft impact. One or more blades 44 can have light strip 46 embedded therein. The light strip 46 can have one or more of the same or different colored lights from a circuit board. In one example, the light strip 46 is embedded in one blade in a front view of the propeller shaped light up toy and another light strip 46 is embedded in another blade in a rear view of the propeller shaped light up toy.

Figure 14:
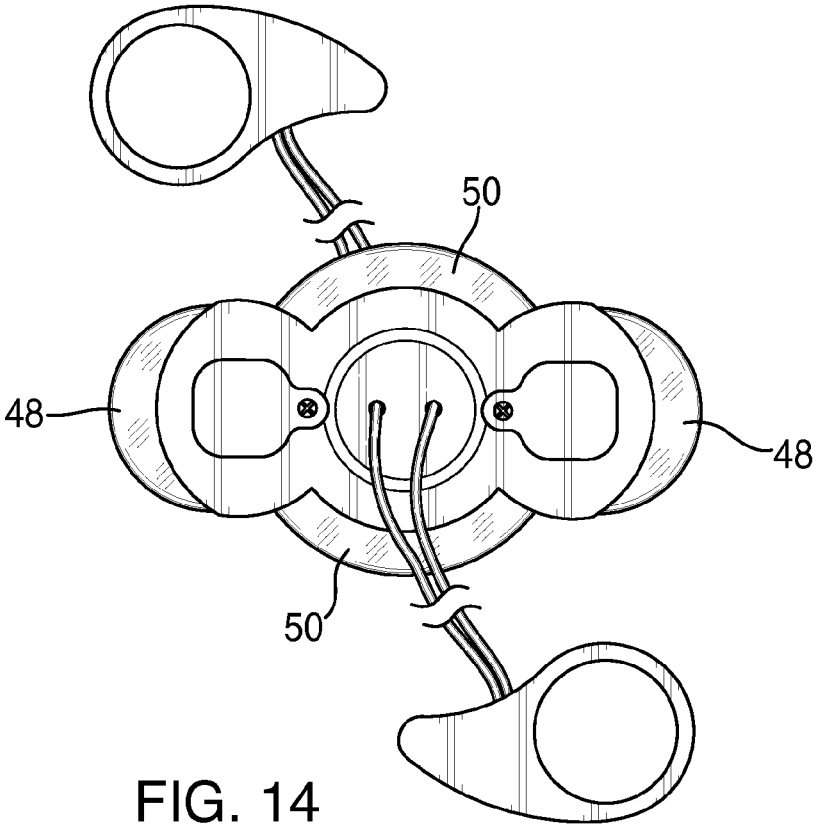
FIG. 14 shows an example of a light up toy.

FIG. 14 shows a light up toy with more than one light and with four covers, two covers 48 on right and left ends of the toy and two covers 50 on top and bottom ends of the toy. Each cover can cover one or more of the same or different colored lights. In one example, each of the light covers 48 cover two lights each and each of the light covers 50 cover one light each.

Figure 15:
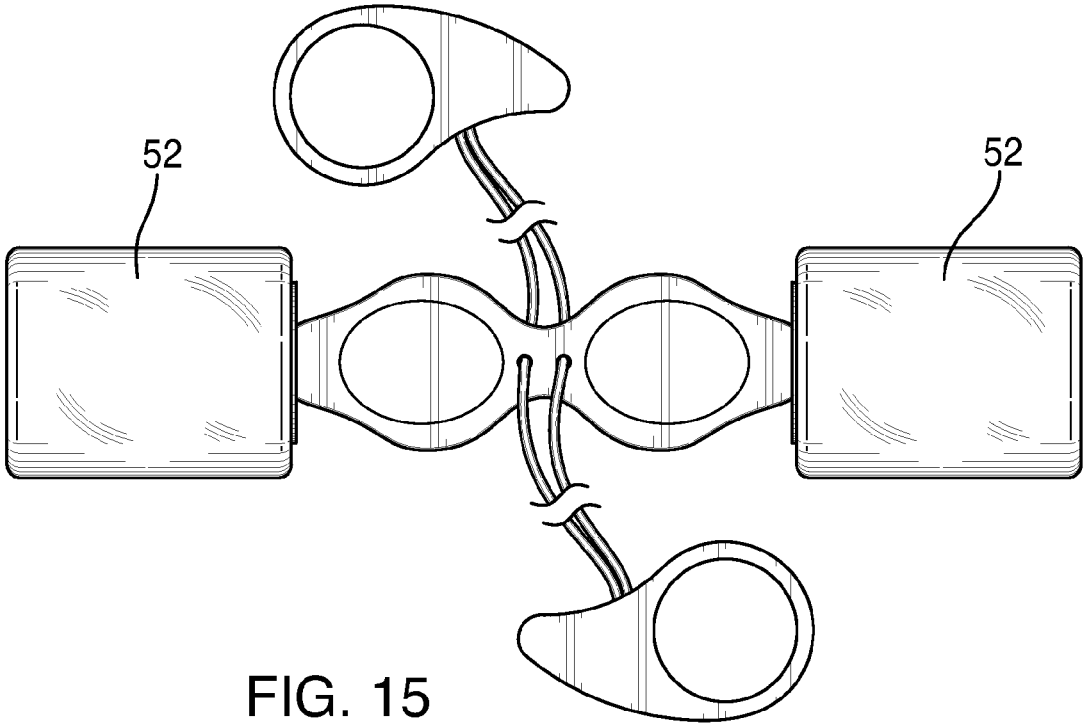
FIG. 15 depicts an example of a two light unit.

FIG. 15 illustrates a light up toy with covers 52 shaped like marshmallows.

Figure 16:
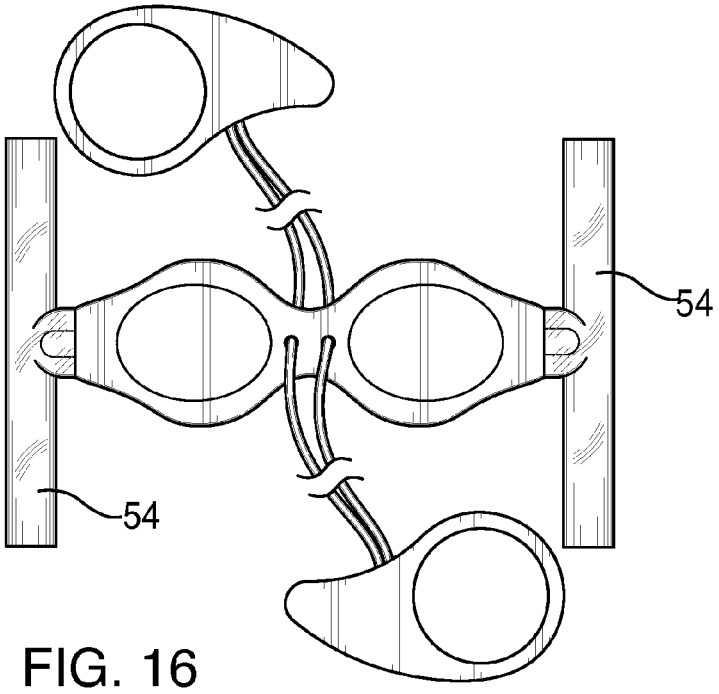
FIG. 16 shows an example of a two light unit.

FIG. 16 depicts a light up toy with t-shaped covers 54.

Figure 17:
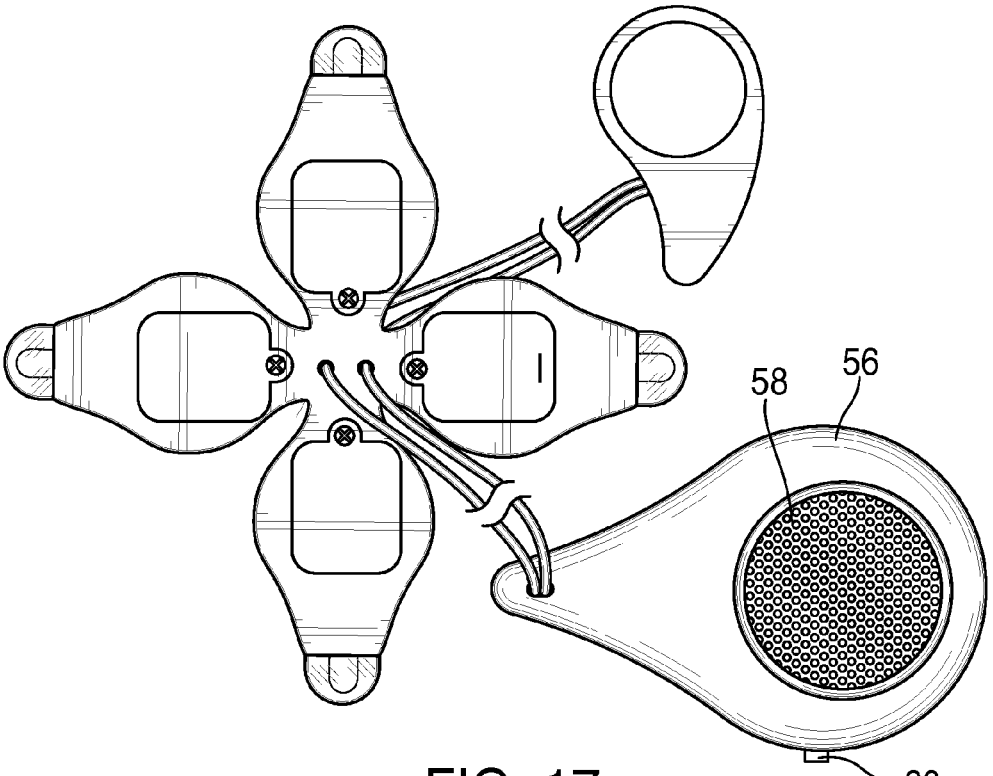
FIG. 17 depicts an example of a four light unit with an MP3 player.

FIG. 17 shows the four light unit 36 of FIG. 7 where one of the handles has been replaced with an MP3 player 56. The MP3 player 56 has a speaker 58 and a power switch 60. In another example, the MP3 player 56 does not have a power switch 60, but is instead automatically turned on when the toy is in use.

What is claimed is:

1. A light up toy comprising:

a one piece molded device having one or more lights;

a string threaded through the device;

a handle on one end of the string;

a second handle on the other end of the string;

a battery section in the device; and a transparent cover for each of the one or more lights to protect the lights from breaking, to disperse the light for a different look, and/or to protect the user, wherein the light up toy makes different patterns of light when the device and string are moved in different ways; and the device is precision balanced to spin on its axis when the string is moved, each of the lights projecting the same or different colors, or having an integrated circuit board to change the color and/or the patterns of light and/or turn the lights on or off.

2. The light up toy of claim 1, wherein the device has 2, 3, or 4 lights.

3. The light up toy of claim 1, wherein the handles are sized to fit one or more fingers or an entire hand, wrist, arm, leg or other body part or stationary item to hold the string.

4. The light up toy of claim 1, further comprising a music player and/or speakers in the handle and/or in the device, the music player is a recorded chip, a memory chip or an MP3 player; a manual or automatic switch for turning on and off the music player and/or speakers, the music player and/or speakers being manually or automatically turned on when the light unit is in motion and manually or automatically turned off when the motion of the light unit stops.

5. The light up toy of claim 1, further comprising a microphone in the device or in the handle.

6. The light up toy of claim 1, further comprising additional lights of any shape that are symmetrical and balanced.

7. The light up toy of claim 1, further comprising an additional string or strings threaded through the device.

8. The light up toy of claim 1, wherein the string measures 850 mm from one end of the string to the other.

9. The light up toy of claim 1, wherein the handle measures 50 mm from one end to the other.

10. The light up toy of claim 1, wherein tension and movement of the string or device are obtained by selectively winding up, pulling, twisting the string and/or swinging the string around to create tension and movement.

11. The light up toy of claim 1, wherein the light covers are the shape of a soccer ball, heart, diamond, clover, and/or spade.

12. The light up toy of claim 1, wherein the lights are fiber optics and have reflective material to reflect the light.

13. The light up toy of claim 1, wherein covers diffuses the light to expand the amount of light coming through or to shape the light.

14. The light up toy of claim 1, wherein the string is threaded through holes in the center of the device and the holes are rounded to prevent the string from fraying.

15. The light up toy of claim 1, wherein the covers are anchored inside the device to hold them in place.

16. A light up toy comprising:

a device having one or more lights;

a string threaded through the device;

a handle on one end of the string;

a second handle on the other end of the string;

at least one battery section in the device;

a transparent cover for each of the one or more lights to protect the lights from breaking; and a locking device for the transparent cover, wherein the light up toy makes different patterns of light when the device and string are moved in different ways; and the device is precision balanced to spin on its axis when the string is moved, each of the lights projecting the same or different colors, or having an integrated circuit board to change the color and/or the patterns of light and/or turn the lights on or off.

17. A light up toy kit comprising:

a one piece molded device having one or more lights;

a string threaded through the device;

a handle on one end of the string;

a second handle on the other end of the string;

a battery section in the device;

a transparent cover for each of the one or more lights to protect the lights from breaking, to disperse the light for a different look, and/or to protect the user; and an instruction book on how to do tricks and create patterns with the lights, wherein the light up toy makes different patterns of light when the device and string are moved in different ways; and the device is precision balanced to spin on its axis when the string is moved, each of the lights projecting the same of different colors, or having an integrated circuit board to change the color and/or the patterns of light and/or turn the lights on or off.

* * * * *